US009655201B2

(12) United States Patent
Chu

(10) Patent No.: US 9,655,201 B2
(45) Date of Patent: May 16, 2017

(54) PIXEL ARRANGEMENT STRUCTURE FOR ORGANIC LIGHT-EMITTING DIODE DISPLAY PANEL

(71) Applicant: EverDisplay Optronics (Shanghai) Limited, Shanghai (CN)

(72) Inventor: Juo-Sheng Chu, Shanghai (CN)

(73) Assignee: EverDisplay Optronics (Shanghai) Ltd., Shanghai (CN)

( * ) Notice: Subject to any disclaimer, the term of this patent is extended or adjusted under 35 U.S.C. 154(b) by 0 days.

(21) Appl. No.: 14/988,417

(22) Filed: Jan. 5, 2016

(65) Prior Publication Data

US 2016/0198544 A1 Jul. 7, 2016

(30) Foreign Application Priority Data

Jan. 5, 2015 (CN) ..... 2015 1 0005518

(51) Int. Cl.

| | |
|---|---|
| ***H01J 1/62*** | (2006.01) |
| ***H05B 33/26*** | (2006.01) |
| ***H05B 33/14*** | (2006.01) |

(52) U.S. Cl.

CPC ..... *H05B 33/26* (2013.01); *H05B 33/14* (2013.01)

(58) Field of Classification Search

CPC ..... H05B 33/26; H05B 33/14
USPC ..... 313/505, 506, 498
See application file for complete search history.

*Primary Examiner* — Vip Patel
(74) *Attorney, Agent, or Firm* — Wang Law Firm, Inc.

(57) ABSTRACT

A pixel arrangement structure for an organic light-emitting diode display panel includes a plurality of first subpixel rows and a plurality of second subpixel rows alternating with the first subpixel rows. Each first subpixel row includes first subpixels and second subpixels alternating with the first subpixels. Each second subpixel row includes alternately disposed first, second, and third subpixels. The number of the third subpixels in each second subpixel row is two times the number of the first or second subpixels in the second subpixel row. The subpixels of the same type in each of the first and second subpixel rows are not adjacent to each other. RGB pixels are formed by combinations of the subpixels in the first subpixel rows and the subpixels in the second subpixels. The color mixing effect is improved, and the resolution is increased.

10 Claims, 2 Drawing Sheets

PIXEL ARRANGEMENT STRUCTURE FOR ORGANIC LIGHT-EMITTING DIODE DISPLAY PANEL

BACKGROUND OF THE INVENTION

The present invention relates to the field of organic light-emitting diodes, more particularly, to a pixel arrangement structure for an organic light-emitting diode display panel.

Organic light-emitting diode (OLED) displays (also known as organic electroluminescent light-emitting displays) are new flat panel display devices having promising applications due to the advantages of thin and light structure, easy manufacture, low costs, low power consumption, high luminance, wide operating temperature range, high speed response, easy colorful display and large display area, easy match with current integrated circuit drivers, and easy soft display.

The pixels of conventional display devices use an RGB side by side arrangement in which a red subpixel, a green subpixel, and a blue subpixel are arranged in a horizontal direction in sequence. However, in application of high resolution, color mixing defects occur, because subpixels having the same color are too close to each other, leading to an increase in the defective loss and an increase in the manufacturing costs.

BRIEF SUMMARY OF THE INVENTION

An objective of the present invention is to provide a pixel arrangement structure for an organic light-emitting diode (OLED) display panel to overcome the disadvantages of poor color mixing and low resolution resulting from close spatial arrangement of subpixels of the same color in the prior art.

In a first aspect, the present invention provides a pixel arrangement structure for an OLED display panel. The pixel arrangement structure includes a plurality of first subpixels, a plurality of second subpixels, and a plurality of third subpixels. The pixel arrangement structure includes a plurality of first subpixel rows and a plurality of second subpixel rows alternating with the plurality of first subpixel rows. Each of the plurality of first subpixel rows includes first subpixels and second subpixels alternating with the first subpixels. Each of the plurality of second subpixel rows includes alternately disposed first, second, and third subpixels. The number of the third subpixels in each of the plurality of second subpixel rows is two times the number of the first or second subpixels in the second subpixel row. The subpixels of the same type in each of the plurality of first and second subpixel rows are not adjacent to each other.

The length of each subpixel in each of the plurality of first subpixel rows in a row direction can be larger than the length of each subpixel in each of the plurality of second subpixel rows in the row direction.

The length of each subpixel in each of the plurality of first subpixel rows in the row direction can be two times the length of each subpixel in each of the plurality of second subpixel rows in the row direction. The length of each subpixel in each of the plurality of second subpixel rows in a column direction can be larger than the length of each subpixel in each of the plurality of first subpixel rows in the column direction.

The length of each subpixel in each of the plurality of second subpixel rows in the column direction can be two times the length of each subpixel in each of the plurality of first subpixel rows in the column direction.

Each third subpixel in each of the plurality of second subpixel rows can be comprised of two minor subpixels, and each of the two minor subpixels has a half third subpixel size.

In a second aspect, a pixel arrangement structure for an organic light-emitting diode display panel includes a plurality of first subpixels, a plurality of second subpixels, and a plurality of third subpixels. The plurality of first subpixels alternates with the plurality of second subpixels in each of an $i_{th}$ row and an $i+1_{th}$ row. Each of the plurality of third subpixels in the $i+1_{th}$ row is located between one of the plurality of first subpixels in the $i+1_{th}$ row and one of the plurality of second subpixels in the $i+1_{th}$ row. Some of the plurality of third subpixels are located in an $i_{th}$ column. Some of the plurality of first subpixels and some of the plurality of second subpixels are alternately disposed in an $i+1_{th}$ column.

A spacing between two adjacent third subpixels in the $i_{th}$ column can be larger than a spacing between each of the plurality of first subpixels and an adjacent second subpixel in the $i+1_{th}$ column.

In a third aspect, a pixel arrangement structure for an organic light-emitting diode display panel includes two first subpixels, two second subpixels, and two third subpixels, forming two pixel units. One of the two first subpixels and one of the two second subpixels are disposed in an $i_{th}$ row. The other first subpixel, the other second subpixel, and the two third subpixels are disposed in an $i+1_{th}$ row. One of the two third subpixels is located between the other first subpixel and the other second subpixel in the $i+1_{th}$ row.

The two third subpixels can be in the same location in the two pixel units. The locations of one of the two first subpixels and one of the two second subpixels in one of the two pixel units relative to each of the two third subpixels are inverted in the other pixel unit.

The advantages effects of the pixel arrangement structure for an OLED display panel are that the color mixing effect is improved, and the resolution is increased by combing the subpixels in the first subpixel rows with the subpixels in the second subpixels to form RGB pixels.

The present invention will become clearer in light of the following detailed description of illustrative embodiments of this invention described in connection with the drawings.

DETAILED DESCRIPTION OF THE INVENTION

Figure 1:
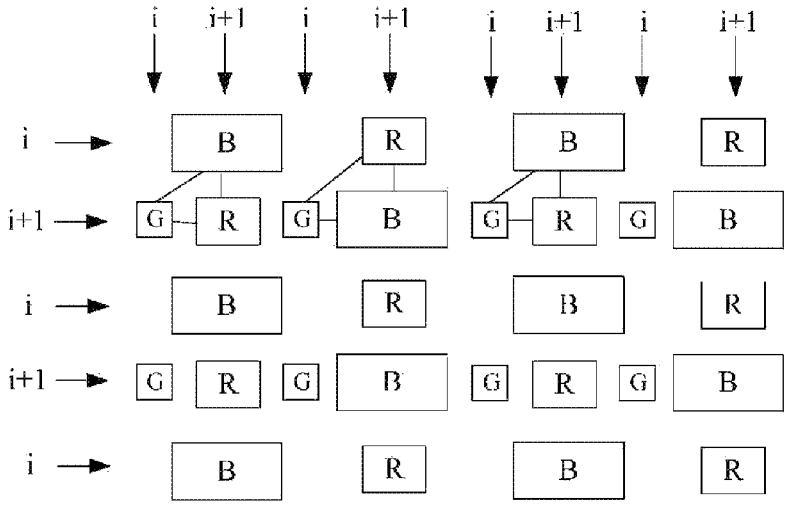
FIG. 1 is a partial, diagrammatic view of a pixel arrangement structure for an organic light-emitting diode display panel of a first embodiment according to the present invention.

In conventional organic light-emitting diode (OLED) display panels including pixels using an RGB side by side arrangement, the subpixels of the same color are too close to each other and, thus, generate color mixing defects while having difficulties in providing high resolution.

In view of the above disadvantages, the present invention provides a pixel arrangement structure for an organic light-emitting diode (OLED) display panel. The pixel arrangement structure includes a plurality of first subpixel rows and a plurality of second subpixel rows alternating with the plurality of first subpixel rows. Each of the plurality of first subpixel rows includes first subpixels and second subpixels alternating with the first subpixels. Each of the plurality of second subpixel rows includes alternately disposed first, second, and third subpixels. The number of the third subpixels in each of the plurality of second subpixel rows is two times the number of the first or second subpixels in the second subpixel row. The subpixels of the same type in each of the plurality of first and second subpixel rows are not adjacent to each other.

By the above technical solution, it can be appreciated that the same subpixels of the pixel arrangement structure for an OLED display panel according to the present invention are not adjacent to each other. By using the subpixels in each of the plurality of first subpixel rows and the subpixels in an adjacent second subpixel row to form an RGB pixel, the color mixing defects resulting from close spatial arrangement of subpixels of the same color are overcome, greatly increasing the resolution under the fixed number of subpixels.

The present invention further provides a pixel arrangement structure for an OLED display panel according to a second aspect. The pixel arrangement structure includes a plurality of first subpixels, a plurality of second subpixels, and a plurality of third subpixels. The plurality of first subpixels alternates with the plurality of second subpixels in each of an $i_{th}$ row and an $i+1_{th}$ row. Each of the plurality of third subpixels in the $i+1_{th}$ row is located between one of the plurality of first subpixels in the $i+1_{th}$ row and one of the plurality of second subpixels in the $i+1_{th}$ row. Some of the plurality of third subpixels are located in an $i_{th}$ column. Some of the plurality of first subpixels and some of the plurality of second subpixels are alternately disposed in an $i+1_{th}$ column.

The present invention further provides an arrangement structure for an OLED display panel according to a third aspect. The pixel arrangement structure includes two first subpixels, two second subpixels, and two third subpixels, forming two pixel units. One of the two first subpixels and one of the two second subpixels are disposed in an $i_{th}$ row. The other first subpixel, the other second subpixel, and the two third subpixels are disposed in an $i+1_{th}$ row. One of the two third subpixels is located between the other first subpixel and the other second subpixel in the $i+1_{th}$ row.

Other advantages and effects of the present invention can easily be appreciated by one skilled in the art from the contents disclosed in the specification by way of certain examples illustrating the embodiments for practicing the present invention. Nevertheless, the present invention can be embodied or applied by other practice. Various modifications or changes can be made to the details of the specification in view of different aspects and applications without departing from the spirit of the present invention.

It is noted that the figures of the embodiments are drawn for ease of explanation of the basic concepts of the present invention only. The components illustrated in the figures are related to the present invention, but they are not drawn according to the number, shapes, and sizes of the components according to actual practice. The pattern, number, and proportion of the components can be varied according to needs in actual practice, and the layout patterns of the components could be more complicated.

The present invention will be described further in connection with the accompanying drawings and specific embodiments.

First Embodiment:

FIG. 1 shows a partial, diagrammatic view of a pixel arrangement structure for an OLED diode display panel of a first embodiment according to the present invention. As shown in FIG. 1, the pixel arrangement structure for an organic light-emitting diode display panel, comprises a plurality of rows of light-emitting diodes, the plurality of rows being sequentially numbered and each row being an odd row or even row. For example, odd row (i) has a plurality of first subpixels (B) and a plurality of second subpixels (R), each odd row (i) being composed of a sequence of pairs, each pair being formed by a first subpixel (b) followed by a second subpixel (R). Each even row (i+1) has a plurality of first subpixels (B), a plurality of second subpixels (R), and a plurality of third subpixels (G), each even row (i+1) having a number of the third subpixels (G) being twice a number of the first subpixels (B) or the second subpixels (R). Each subpixel of the plurality of first subpixels (B), the plurality of second subpixels (R), or the plurality of third subpixels (G) is not disposed adjacent to a subpixel of a same type. Further, the RGB subpixel arrangement structure according to the present invention includes a plurality of first subpixel rows and a plurality of second subpixel rows alternating with the plurality of first subpixel rows. Each of the plurality of first subpixel rows includes first subpixels (B) and second subpixels (R) alternating with the first subpixels (B). Each of the plurality of second subpixel rows includes alternately disposed first (B), second (R), and third subpixels (G). FIG. 1 also shows the plurality of third subpixels (G) distributed on the odd (i) columns and the plurality of first subpixels (B) and the plurality of second subpixels (R) distributed on the even (i+1) columns.

In the first embodiment, the first subpixels and the second subpixels in each first subpixel row are blue subpixels B and red subpixels R. The first, second, and third subpixels in each second subpixel row are blue, red, and green subpixels B, R, and G. When viewed in the row direction, the blue subpixels B alternate with the red subpixels R in each first subpixel row, such as BRBRBR . . . BRBRBR. Furthermore, an empty column exists between each blue pixel B and an adjacent red subpixel R. In each second subpixel row, the blue subpixels B alternate with the red subpixels R in the row direction, and a green subpixel G is located between a blue subpixel B and a red subpixel R, such as GRGBGRGB . . . GRGB. When viewed from the column direction, a spacing between two green subpixels G in the $i_{th}$ column is larger than a spacing between each blue subpixel B and an adjacent red subpixel R in the $i+1_{th}$ column. Namely, the green subpixels G are arranged in the $i_{th}$ column, and an empty row exits between two adjacent green subpixels G The blue subpixels B alternate with the red subpixels R in the $i+1_{th}$ column, such as BRBRBR . . . BRBR.

Thus, as shown in FIG. 1, in each second subpixel row, the number of the third subpixels is two times the number of the first or second subpixels. For example, in each second subpixel row, the number of green subpixels G is two times the number of the blue or red subpixels B or R. Furthermore, the subpixels of the same type in each of the first and second subpixel rows are not adjacent to each other.

According to the RGB subpixel arrangement structure shown in FIG. 1, in actual practice, an RGB pixel can be formed by a subpixel of a first type in one of the first subpixel rows and two subpixels of the other two types in an adjacent second subpixel row. In an example, an RGB pixel is formed a blue subpixel B in one of the first subpixel rows and an adjacent green subpixel G and an adjacent red subpixel R in an adjacent second subpixel row (see the connection lines in FIG. 1). In another example, an RGB pixel is formed a red subpixel R in one of the first subpixel rows and an adjacent green subpixel G and an adjacent blue subpixel B in an adjacent second subpixel row (see the connection lines in FIG. 1). As can be seen from the connection lines in FIG. 1, two pixel units are formed by two blue subpixels B, two red subpixels R, and two green subpixels G. One of the two blue subpixels B and one of the two red subpixels R are disposed in the $i_{th}$ row. The other blue subpixel B, the other red subpixel R, and the two green subpixels G are disposed in the $i+1_{th}$ row. One of the two green subpixels G is located between the other blue subpixel B and the other red subpixel R in the $i+1_{th}$ row. Furthermore, in two adjacent RGB pixels, the green subpixels G are in the same location in the two RGB pixel units, and the locations of one of the two blue subpixels B and one of the two red subpixels R in one of the two RGB pixel units relative to each of the two green subpixels G are inverted in the other RGB pixel unit.

It can be appreciated that the two types of subpixels in each first subpixel row and the three types of subpixels in each second subpixel row in the first embodiment are not limited by the example shown. As an example, the two types of subpixels in each first subpixel row can be blue subpixels B and red subpixels R. The red subpixels R can be the subpixels having the greatest number among the three subpixels. As another example, the two types of subpixels in each first subpixel row can be red subpixels R and green subpixels G The blue subpixels B can be the subpixels having the greatest number among the three subpixels.

Figure 2:
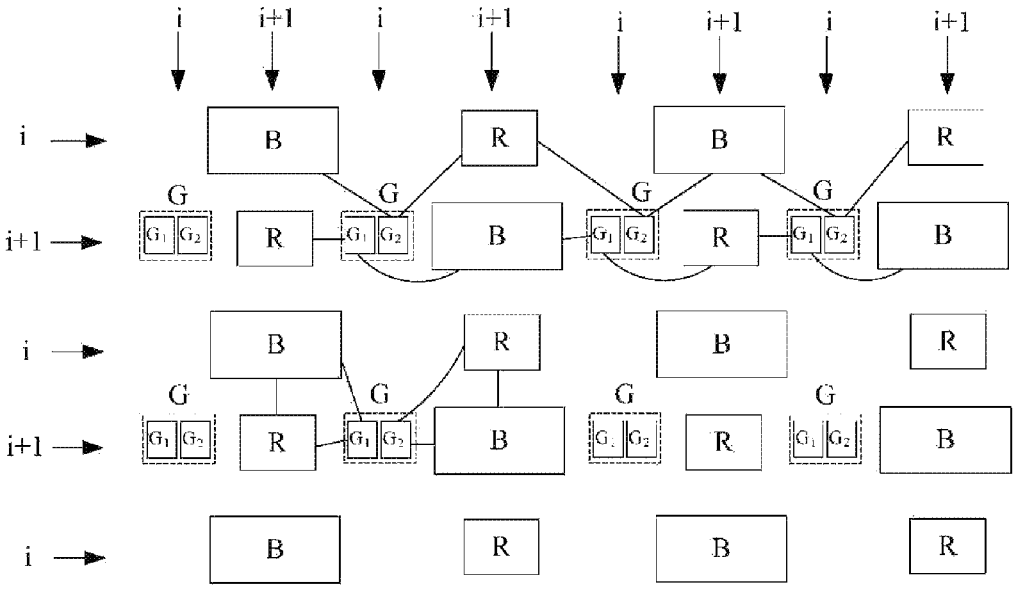
FIG. 2 is a partial, diagrammatic view of a pixel arrangement structure for an organic light-emitting diode display panel of a second embodiment according to the present invention.

Second Embodiment:

FIG. 2 is a partial, diagrammatic view of a pixel arrangement structure for an OLED display panel of a second embodiment according to the present invention. As shown in FIG. 2, the RGB subpixel arrangement structure according to the present invention includes a plurality of first subpixel rows and a plurality of second subpixel rows alternating with the plurality of first subpixel rows. Each of the plurality of first subpixel rows includes first subpixels and second subpixels alternating with the first subpixels. Each of the plurality of second subpixel rows includes alternately disposed first, second, and third subpixels.

In this embodiment, the first subpixels and the second subpixels in each first subpixel row are blue subpixels B and red subpixels R. The first, second, and third subpixels in each second subpixel row are blue, red, and green subpixels B, R, and G. When viewed in the row direction, the blue subpixels B alternate with the red subpixels R in each first subpixel row, such as BRBRBR . . . BRBRBR. Furthermore, an empty column exists between each blue pixel B and an adjacent red subpixel R. In each second subpixel row, the blue subpixels B alternate with the red subpixels R in the row direction, and a green subpixel G is located between a blue subpixel B and a red subpixel R, such as GRGBGRGB . . . GRGB. When viewed from the column direction, the green subpixels G are arranged in the $i_{th}$ column, and an empty row exits between two adjacent green subpixels G The blue subpixels B alternate with the red subpixels R in the $i+1_{th}$ column, such as BRBRBR . . . BRBR.

Thus, in each second subpixel row, the number of the third subpixels is two times the number of the first or second subpixels. For example, in each second subpixel row, the number of green subpixels G is two times the number of the blue or red subpixels B or R. Furthermore, the subpixels of the same type in each of the first and second subpixel rows are not adjacent to each other.

Compared to the first embodiment, in each second subpixel row, each green subpixel G is comprised of two green minor subpixels $G_1$ and $G_2$, and each of the two green minor subpixels $G_1$ and $G_2$ has a half green subpixel size. In this way, the subpixel arrangement in each subpixel row is changed from GRGBGRGB . . . GRGB into $G_1G_2RG_1G_2BG_1G_2RG_1G_2B$ . . . $G_1G_2RG_1G_2B$.

According to the RGB subpixel arrangement structure shown in FIG. 2, in actual practice, an RGB pixel can be formed by a subpixel of a first type in one of the first subpixel rows and two subpixels of the other two types in an adjacent second subpixel row (see the connection lines in FIG. 2). Alternatively, an RGB pixel can be formed by two subpixels of two types in one of the first subpixel rows and a subpixel of the last type in an adjacent second subpixel row (see the connection lines in FIG. 2). Alternatively, an RGB pixel can be formed by three subpixels respectively of three types in the same second subpixel row (see the connection lines in FIG. 2). Since each green subpixel G can be comprised of two green minor subpixels $G_1$ and $G_2$, the subpixels can have more combinations to form more RGB pixels, greatly increasing the display resolution.

Figure 3:
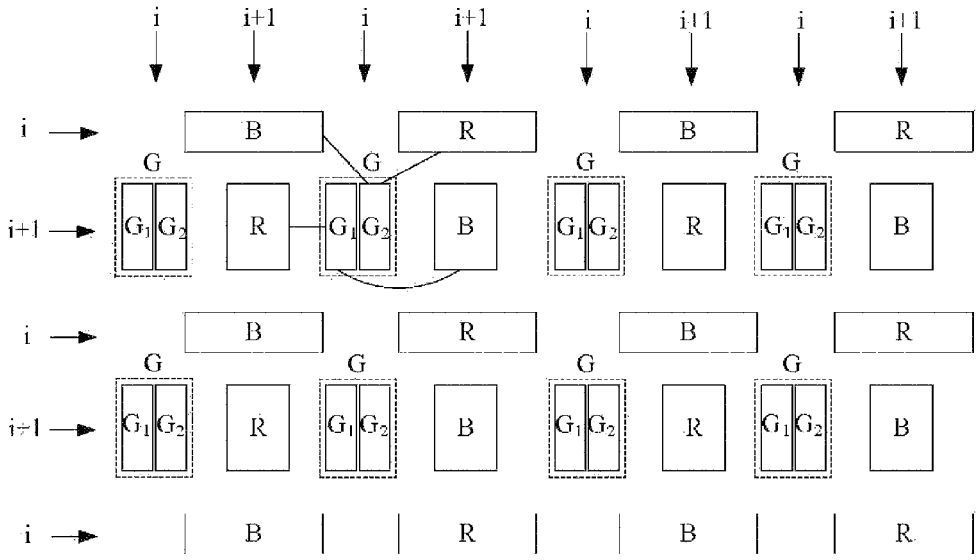
FIG. 3 is a partial, diagrammatic view of a pixel arrangement structure for an organic light-emitting diode display panel of a third embodiment according to the present invention.

Third Embodiment:

FIG. 3 shows a partial, diagrammatic view of a pixel arrangement structure for an OLED diode display panel of a third embodiment according to the present invention. As shown in FIG. 3, the RGB subpixel arrangement structure according to the present invention includes a plurality of first subpixel rows and a plurality of second subpixel rows alternating with the plurality of first subpixel rows. Each of the plurality of first subpixel rows includes first subpixels and second subpixels alternating with the first subpixels, such as blue subpixels B and red subpixels R. Each of the plurality of second subpixel rows includes alternately disposed first, second, and third subpixels, such as blue subpixels B, red subpixels R, and green subpixels G.

When viewed in the row direction, the blue subpixels B alternate with the red subpixels R in each first subpixel row, such as BRBRBR . . . BRBRBR. Furthermore, an empty column exists between each blue pixel B and an adjacent red subpixel R. In each second subpixel row, the blue subpixels B alternate with the red subpixels R in the row direction, and a green subpixel G is located between a blue subpixel B and a red subpixel R, such as GRGBGRGB . . . GRGB. When viewed from the column direction, the green subpixels G are arranged in the $i_{th}$ column, and an empty row exits between two adjacent green subpixels G. The blue subpixels B alternate with the red subpixels R in the $i+1_{th}$ column, such as BRBRBR . . . BRBR.

In each second subpixel row, the number of the third subpixels is two times the number of the first or second subpixels. For example, in each second subpixel row, the number of green subpixels G is two times the number of the blue or red subpixels B or R. Furthermore, the subpixels of the same type in each of the first and second subpixel rows are not adjacent to each other.

In the third embodiment, in each second subpixel row, each green subpixel G is comprised of two green minor subpixels $G_1$ and $G_2$, and each of the two green minor subpixels $G_1$ and $G_2$ has a half green subpixel size. In this way, the subpixel arrangement in each subpixel row is changed from GRGBGRGB . . . GRGB into $G_1G_2RG_1G_2BG_1G_2RG_1G_2B$ . . . $G_1G_2RG_1G_2B$.

According to the RGB subpixel arrangement structure shown in FIG. 3, in actual practice, an RGB pixel can be formed by a subpixel of a first type in one of the first subpixel rows and two subpixels of the other two types in an adjacent second subpixel row (see the connection lines in FIG. 3). Alternatively, an RGB pixel can be formed by two subpixels of two types in one of the first subpixel rows and a subpixel of the last type in an adjacent second subpixel row (see the connection lines in FIG. 3). Alternatively, an RGB pixel can be formed by three subpixels respectively of three types in the same second subpixel row (see the connection lines in FIG. 3). Since each green subpixel G can be comprised of two green minor subpixels $G_1$ and $G_2$, the subpixels can have more combinations to form more RGB pixels, greatly increasing the display resolution.

Compared to the first and second embodiments, in the third embodiment, the angular positon of each subpixel in each first subpixel row is at an angle of 90° relative to the subpixels in an adjacent second subpixel row. Specifically, the length of each subpixel in each first subpixel row in the row direction is two times the length of each subpixel in each second subpixel row in the row direction. Likewise, the length of each subpixel in each second subpixel row in the column direction is two times the length of each subpixel in each subpixel row in the column direction.

The advantages effects of the pixel arrangement structure for an OLED display panel include the first subpixel rows alternating with the second subpixel rows. Each first subpixel row includes first subpixels and second subpixels alternating with the first subpixels. Each second subpixel row includes alternately disposed first, second, and third subpixels. The subpixels of the same type in each of the first and second subpixel row are not adjacent to each other. Thus, the color mixing defects resulting from close spatial arrangement of the subpixels of the same color are overcome.

Furthermore, the number of the third subpixels in each second subpixel row is two times the number of the first or second subpixels in the second subpixel row. RGB pixels can be formed by combinations of the subpixels in the first subpixel rows and the subpixels in the second subpixels. Furthermore, each green subpixel G can be comprised of two green minor subpixels $G_1$ and $G_2$, the subpixels can have more combinations to form more RGB pixels, greatly increasing the display resolution.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A pixel arrangement structure for an organic light-emitting diode display panel, comprising a plurality of rows of light-emitting diodes, the plurality of rows being sequentially numbered and each row being an odd row or even row, wherein each odd row has a plurality of first subpixels and a plurality of second subpixels, each odd row is composed of a sequence of pairs, each pair is formed by a first subpixel followed by a second subpixel, each even row has a plurality of first subpixels, a plurality of second subpixels, and a plurality of third subpixels, each even row has a number of the third subpixels being twice a number of the first subpixels or the second subpixels, each subpixel of the plurality of first subpixels, the plurality of second subpixels, or the plurality of third subpixels is not disposed adjacent to a subpixel of a same type.

2. The pixel arrangement structure for an organic light-emitting diode display panel according to claim 1, wherein a length of each subpixel in each odd row is larger than a length of each subpixel in each even row.

3. The pixel arrangement structure for an organic light-emitting diode display panel according to claim 2, wherein the length of each subpixel in each odd row is two times the length of each subpixel in each even row.

4. The pixel arrangement structure for an organic light-emitting diode display panel according to claim 2, wherein a length of each subpixel in each even row in a column direction is larger than a length of each subpixel in each odd row in the column direction.

5. The pixel arrangement structure for an organic light-emitting diode display panel according to claim 4, wherein the length of each subpixel in each even row in the column direction is two times the length of each subpixel in each odd row in the column direction.

6. The pixel arrangement structure for an organic light-emitting diode display panel according to claim 1, wherein each third subpixel in each odd row is comprised of two minor subpixels, and each of the two minor subpixels has a half size of a size of a third subpixel.

7. A pixel arrangement structure for an organic light-emitting diode display panel, comprising a plurality of first subpixels, a plurality of second subpixels, and a plurality of third subpixels distributed in a plurality of rows and columns, each row being an odd row or an even row and each column being an odd column or even column, wherein:

a pair of a first subpixel followed by a second subpixel is repeated for each odd row and an each even row, and each third subpixel in an even row is located between a first subpixel in the even row and a second subpixel in the even row; and some third subpixels are located in an odd column, and some first subpixels and some second subpixels are alternately disposed in an even column.

8. The pixel arrangement structure for an organic light-emitting diode display panel according to claim 7, wherein a spacing between two adjacent third subpixels in the odd column is larger than a spacing between a first subpixel and an adjacent second subpixel in the even column.

9. A pixel arrangement structure for an organic light-emitting diode display panel, comprising two first-type subpixels, two second-type subpixels, and two third-type subpixels, forming two pixel units, with a first first-type subpixel and a first second-type subpixel disposed in a row, with a second first-type subpixel, second a second second-type subpixel, and the two third-type subpixels disposed in an adjacent row, and with a first third-type subpixel located between the second first-type subpixel and the second second-type subpixel in the adjacent row.

10. The pixel arrangement structure for an organic light-emitting diode display panel according to claim 9, wherein the two third-type subpixels are in a same location in the two pixel units, and wherein locations of one first-type subpixel and one second-type subpixel in one of the two pixel units relative to each of the two third-type subpixels are inverted in another of the two pixel units.

* * * * *